US005127895A

United States Patent [19]

Pawlovich

[11] Patent Number: 5,127,895

[45] Date of Patent: Jul. 7, 1992

[54] SELF-SEAL CENTRIFUGE TUBE

[75] Inventor: Randy B. Pawlovich, Menlo Park, Calif.

[73] Assignee: Beckman Instruments, Inc., Fullerton, Calif.

[21] Appl. No.: 502,591

[22] Filed: Mar. 30, 1990

[51] Int. Cl.[5] ..... B04B 15/00; B65D 39/08

[52] U.S. Cl. ..... 494/16; 215/277; 215/364; 494/20

[58] Field of Search ..... 494/16, 20, 45, 26; 215/271, 273, 277, 278, 355, 364

[56] References Cited

U.S. PATENT DOCUMENTS

| | | | |
|---|---|---|---|
| 228,696 | 6/1880 | Thompson | 215/364 |
| 668,501 | 2/1901 | Davis | 215/355 |
| 1,007,887 | 11/1911 | Mount | 215/278 |
| 3,071,316 | 1/1963 | Piemonte et al. . | |
| 3,133,882 | 5/1964 | Mitchell et al. | 494/16 |
| 3,307,728 | 3/1967 | Elser . | |
| 3,434,615 | 3/1969 | Barletta . | |
| 3,441,205 | 4/1969 | Young, Jr. | 215/DIG. 3 X |
| 3,499,568 | 3/1970 | Riera . | |
| 3,898,046 | 8/1975 | Ikeda et al. | 215/DIG. 3 X |
| 3,901,434 | 8/1975 | Wright . | |
| 3,938,735 | 2/1976 | Wright et al. . | |
| 3,998,383 | 12/1976 | Romanauskas . | |
| 4,076,142 | 2/1978 | Naz | 215/271 X |
| 4,116,352 | 9/1978 | Davis . | |
| 4,190,196 | 2/1980 | Larsen . | |
| 4,222,513 | 9/1980 | Webster et al. . | |
| 4,285,904 | 8/1981 | Ishimaru et al. . | |
| 4,301,963 | 11/1981 | Nielsen . | |
| 4,304,356 | 12/1981 | Chulay et al. . | |
| 4,537,320 | 8/1985 | Nielsen . | |
| 4,690,670 | 9/1987 | Nielsen . | |

OTHER PUBLICATIONS

Official Gazette, (May 29, 1984), vol. 1042, No. 5, pp. 2071 (See U.S. Pat. No. 4,451,250 to E. I. Du Pont de Nemours and Company).

*Primary Examiner*—Daniel M. Yasich

*Attorney, Agent, or Firm*—William H. May; P. R. Harder; Wen Liu

[57] ABSTRACT

A means of sealing a centrifuge tube which makes use of the hydrostatic pressure of the sample solution contained in the tube to perfect a tight seal during centrifugation. The filler stem is plugged with a plug which is supported in the rotor cavity. The hydrostatic pressure forces the filler stem against the plug to effect a seal with a sealing force which is dependent on the hydrostatic pressure which is in turn dependent on the centrifugal force on the sample solution.

13 Claims, 2 Drawing Sheets

SELF-SEAL CENTRIFUGE TUBE

BACKGROUND OF THE INVENTION

1. Field of the Invention

The present invention relates to centrifuge tubes and, more particularly, to the sealing or closing of centrifuge tubes.

2. Description of Related Art

Typical centrifuge tubes have a generally uniform cylindrical shape with one end having an opening to receive the fluid sample to be subjected to centrifugation. After the introduction of the fluid sample into the tube, it is usually necessary to provide a very tight closure or capping means over the open-end of the tube during centrifugation. The closure or capping mechanism must be extremely tight, especially when the tube is used in a centrifuge rotor of the type known as a fixed-angle rotor in which the tube cavities are oriented at an acute angle or approach an angle of 0° with respect to the spin axis of the rotor. Hydrostatic pressure within the tube becomes extremely great when the centrifuge is rotated at speeds of 20,000 rpm or greater.

A continual problem with the placement of capping means on the open-ended centrifuge tubes is insuring that a proper seal is being achieved between the plug and the tube to prevent any possible or potential leakage which could occur. Although swinging bucket type rotors do not require capping means to establish a seal over the top of the centrifuge tube because the centrifugal forces are directed toward the bottom of the bucket, sealing concerns increase as the angle of orientation of the tube axis with respect to the spin axis is less than 90°. The most significant concern for sealing the centrifuge tube occurs when the angle of the tube with respect to the spin axis is zero or essentially vertical.

The significance of eliminating or preventing any potential leakage in a high speed centrifuge cannot be underestimated, because the fluid sample may contain some type of pathogen, mutagen, bacteria or some valuable type of material which the user does not wish to lose through leakage during the centrifugation run. Further, any leakage which may occur during the centrifugation run will invalidate the run resulting in great inefficiency in the use of the centrifuge. Since many of the fluid samples which are investigated during the centrifuge run contain important ingredients for use by a scientist or technician, the leakage of a centrifuge tube during a run can create significant problems as well as the waste of an operator's time. Moreover leakage will cause rotor imbalance and result in rotor mishap.

In many instances, the resulting leak is caused by an improper seal being achieved between the capping means and the centrifuge tube because of either a poor configuration or design of the capping means or as a result of the improper placement of the capping means on the tube. Not only is it important that the capping means be designed to achieve a secure seal between the test tube and the capping means, but also it is important that the capping means have such a design that it is easy to remove after the centrifuge run without having to disturb the contents of the fluid sample after the centrifugation. Otherwise, the sample constituents may be remixed and invalidate the centrifugation run.

Various configurations have been devised for capping centrifuge tubes to eliminate any potential leakage which may occur. Typically, the capping means is utilized on a disposable type of centrifuge tube which is somewhat flexible. Present capping means are typically very complicated in their manufacture and construction as well as in their use and application for attachment to the tube. Many of the capping means used are designed to tightly grip the open-end of the centrifuge tube which is flexible or pliable and conform the open-end of the tube to the gripping portion of the capping means. However, the open-end of the tube must be inserted properly and completely within the capping means in order to achieve a secure seal when the capping means is tightened. Unfortunately, the tube often is not completely inserted within the capping means so that when the plug is tightened, a proper seal is not achieved.

U.S. Pat. No. 4,537,320 describes a capping means which includes a support crown for fitting around the filler stem of the centrifuge tube and a threaded swage plug which threads within the support crown to cause a swage seal to be formed between the filler stem and the plug. U.S. Pat. No. 4,690,670 describes the use of a self-tapping screw plug for sealing a plastic centrifuge tube. Both of these sealing means require hand tools for tightening the threaded plugs. It is often difficult to apply the right amount of torque when the plugs are tightened. Insufficient torquing results in an inadequate seal against high hydrostatic pressure in the tube while over-torquing results in stripping of the threads of the plastic components which will destroy the sealing function of the plugs.

U.S. Pat. No. 4,301,963 discloses the sealing of the narrow stem of an integral one-piece centrifuge tube by fusing the plastic material of the neck. U.S. Pat. No. 4,285,904 discloses sealing a narrow stem centrifuge tube by fusing a plug member over the neck of the centrifuge tube. While these methods produces good seals for narrow stem centrifuge tubes, the methods are not suitable for wide stem centrifuge tubes. It is sometimes preferable to use wide stem tubes over narrow stem tubes because it is easier to load and unload the tubes with sample solution. The wider opening allows the use of larger diameter pipettes and syringes. For biological samples made up of large molecules, the larger diameter instruments causes less shear on the large molecules being transferred into or out of the wide stem centrifuge tubes, thereby less damage to the sample. Furthermore, the centrifuge tubes that are heat-sealed can only be used once since the sealed stem is cut off before the sample is removed after centrifugation. Still further, the heat seal technique requires special sealing tools including heaters. Thus, the cost for practicing heat sealing of centrifuge tubes is expensive compared to mechanical capping methods.

SUMMARY OF THE INVENTION

The present invention is directed to a sealing technique which makes use of the hydrostatic pressure of the sample solution contained within the centrifuge tube during centrifugation to perfect a tight seal. The stem of the centrifuge tube is capped with a plug prior to centrifugation. Upon centrifugation, hydrostatic pressure which occurs as a result of the centrifugal force on the solution causes the tube stem to press on the plug against a support provided by a spacer fixed in place within the cavity or the centrifugal weight of the plug. As a result, a seal is formed between the plug and the tube stem. As centrifugal forces increase with an increase in rotor speed, the hydrostatic pressure increases thereby forcing a tighter seal of the plug against the tube stem.

The present invention effectively provides a means of sealing a centrifuge tube wherein the sealing force is commensurated with the magnitude of the hydrostatic pressure which is dependent on the centrifugal force experienced by the sample solution contained in the tube. Negligible sealing force is present prior to centrifugation. A tighter seal is automatically provided during high speed centrifugation to counter the large hydrostatic forces. Because of the weak seal after centrifugation, it is easy for the user to plug and unplug the centrifuge tube without requiring any special tools. This technique works well with wide stem tubes. The tubes may be reusable if desired as the seal itself does not alter the structure of the centrifuge tube in any way.

DESCRIPTION OF ILLUSTRATED EMBODIMENTS

The following description is of the best presently contemplated mode of carrying out the invention. This description is made for the purpose of illustrating the general principles of the invention and should not be taken in a limiting sense. The scope of the invention is best determined by reference to the appended claims.

The present invention will be described with reference to centrifuge tubes that have a generally cylindrical body portion with generally hemispherical top and bottom portions both of which are integrally formed with the cylindrical body portion (see FIG. 1). The neck or filler stem of the tube is integrally formed around an opening in the top portion. It will be appreciated that the present invention can be practiced with centrifuge tubes of other body shapes.

Figure 1:
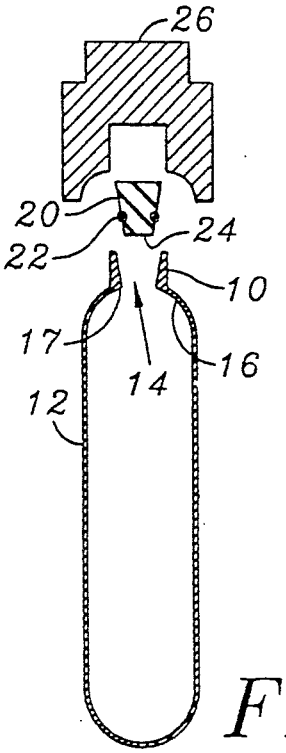
FIG. 1 is a sectional view of a centrifuge tube and a capping assembly in accordance with one embodiment of the present invention.

FIG. 1 shows a capping assembly in accordance with one embodiment of the present invention. The exterior of the stem 10 of the centrifuge tube 12 is generally cylindrical. The interior of the stem 10 defines a conically tapered opening 14 which widens outward from the tube 12 at a 12° taper. The stem 10 is integrally formed with the top hemispherical portion 16 of the tube 12. The plug 20 comprises a conically tapered portion having an o-ring 22 retained in an annular groove 24. The taper of the plug is approximately the same as that of a the tube stem opening 14. The o-ring 22 protrudes above the tapered surface of the plug 20. When the plug 20 is inserted into the opening of the tube stem 10, the o-ring 22 comes into sealing contact with the tapered interior surface of the tube stem 10. The tube 12 can be made from a thermoplastic or thermoset material preferably having a translucent or transparent characteristic. Polypropylene is an acceptable material and the tube can be formed by extrusion or blow molding methods. The plug 20 can also be made from the same material but preferably from polyphenylene oxide or like material which is slightly harder than polypropylene but with comparable specific gravity.

The tube 12 is capped by inserting the plug 20 into the tube stem opening 14. One may use moderate pressure to cause a weak interference fit so as to prevent the plug 20 from popping out of the tube stem when the tube is handled. It is noted that the force required to plug and unplug the tube stem 10 is small and can be applied directly with the fingers of the user. Because the tube 12 and/or plug 20 are made of generally flexible material, the interference fit between the tube stem 10 and the plug 20 can be overcome by modest forces without using any tools.

In combination with the plug 20, a spacer 26 is used to provide a support for the plug 20 against hydrostatic pressure within the tube. In addition, the spacer 26 also provides support to the upper hemispherical portion 16 of the tube. These will be discussed in detail below. The spacer 26 is specifically designed to have an interior surface that is shaped to generally conform to the plug 20, tube stem 10 and upper hemispherical portion 16 of the centrifuge tube. As the spacer 26 will be inserted into the rotor cavity (see FIG. 2), the top of the spacer is shaped to allow easy removal from the rotor cavity. The spacer can be made from plastic or light metal such as aluminum.

Figure 2:
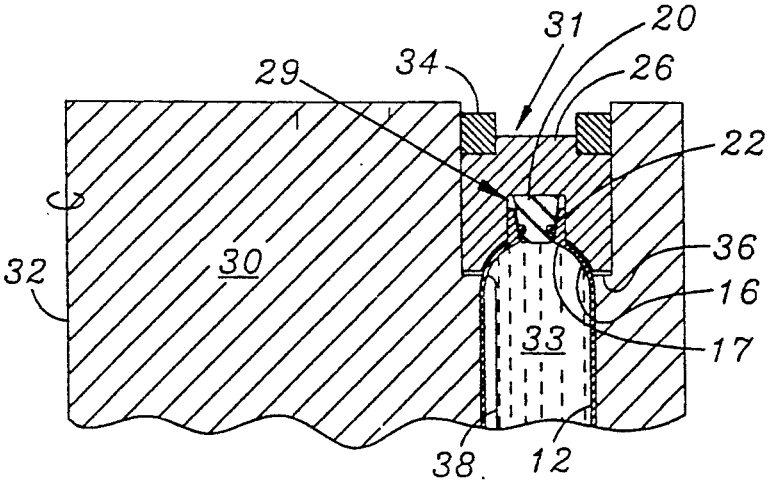
FIG. 2 illustrates the implementation of the capping assembly in a vertical tube rotor.
Figure 3:
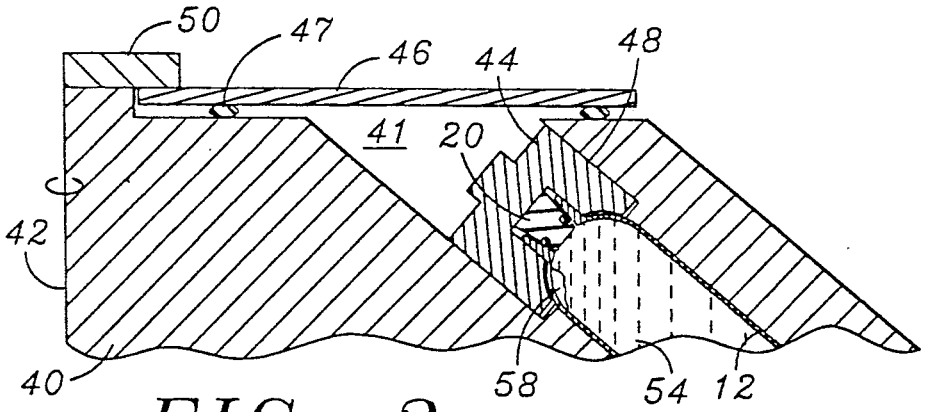
FIG. 3 illustrates the implementation of the capping assembly in a fixed angle rotor.
Figure 4:
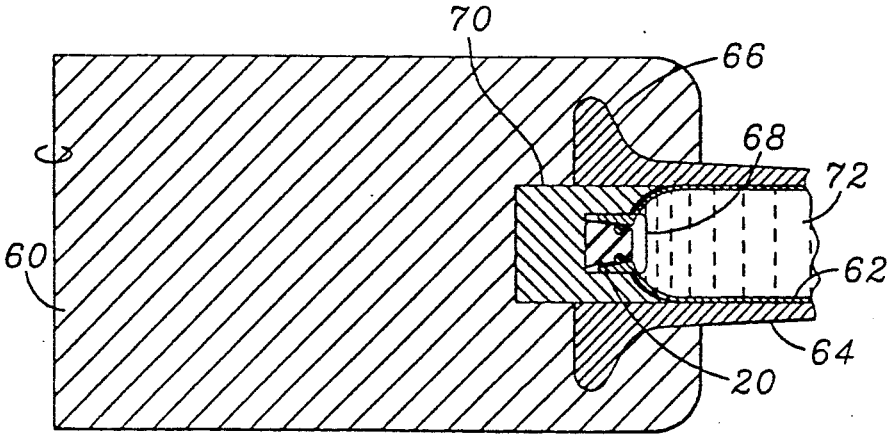
FIG. 4 illustrates the implementation of the capping assembly in a swinging bucket rotor.

Referring to FIGS. 2 to 4, the installations of the centrifuge tube 12 and its capping assembly in various types of centrifuge rotors will be described. The rotor 30 shown in FIG. 2 is often referred to as a vertical tube rotor. It has several cavities 31 oriented vertically and arranged in a circle at equal distance from the spin axis 32. The cavities are shaped to receive the centrifuge tube 12 and its accompanying capping assembly. The centrifuge tube 12 is filled with a sample solution 33 prior to inserting into the rotor cavity 31. As will be appreciated, the capping assembly of the present invention can be applied to wide stem centrifuge tubes. Therefore, the larger opening 14 allows for the use of large diameter syringes or pipettes to load the sample into the tube. This reduces the shear on large biological molecules being loaded into the tube, thereby preserving the integrity of the sample prior to centrifugation. Similarly, when the separated sample is subsequently extracted from the tube after centrifugation, large diameter siphoning tools can be used.

The tube 12 is plugged and inserted into the rotor cavity 31 followed by the spacer 26. A plug 34 is screwed into the opening of the cavity 31 to fix the spacer 26 in place to prevent any upward movement of the spacer. The plug 34 is also used to initially load the spacer 26 against the plug 20. The height of the tube stem 10 is sized such that a space 29 is provided between the edge of the tube stem and the spacer 26 upon preloading of the plug 20 and spacer 26 using the rotor cavity plug 34. It is preferred to provide a counterbore 36 in the cavity 31 to limit the downward travel of the spacer 26 upon tightening the plug 34. This prevents deforming the centrifuge tube 12 from overtightening of the plug 34.

Upon centrifugation, the sample solution 33 within the tube is subject to centrifugal force radially outward with respect to the spin axis 32. The solution 33 takes a vertical orientation and a vertical meniscus 38 is formed. The amount of air space above the meniscus will depend on the level to which the tube is filled with sample solution. Although a large air space above the meniscus is shown in exaggeration for clarity, it is preferred to fill the tube completely to keep the air space above the meniscus as small as possible in order to avoid the walls of the tube from otherwise collapsing under the high centrifugal force. As can be seen from FIG. 2, the vertical column of sample solution 33 comes into contact with a portion of the upper hemispherical portion 16 of the tube and the plug 20. Depending on the level of the sample solution 33 to which the tube 12 was filled, a substantial portion of the upper portion 16 of the tube around the plug 20 is subject to hydrostatic pressure of the sample solution 33 upon centrifugation. Upward movement of the plug 20 under hydrostatic pressure is constrained by the spacer 26. The hydrostatic pressure acting on the root region 17 of the tube stem 10 deforms the region slightly and pushes, the tube stem 10 upwards against the o-ring 22. The seal against the o-ring 22 becomes tighter as a result. The space 29 allows room for the tube stem 10 to be pushed upwards. Thus, as the rotor speed increases, the centrifugal force and hence the hydrostatic pressure increases thereby increasing the sealing force at the interface of the o-ring 22 and tube stem 10. The increased sealing force offsets for the increase in hydrostatic pressure thereby maintaining a tight leak-proof seal. In otherworld, the seal becomes "better" as the pressure condition becomes more severe.

When centrifugation is completed, the plug 34 is unscrewed and the spacer 26 is removed with a tweezer from the rotor cavity. The centrifuge tube 12 is pulled out of the cavity 31 and the plug 20 can be removed by fingers without any tool.

The plug 34 and the spacer 26 may be made in one piece. However, it is preferred to have separate plug 34 and spacer 26 for several reasons. First, it is desirable to avoid rotation of the spacer with respect to the capped region of the tube while the plug is being screwed into the cavity. Second, centrifuge tubes come in different sizes and shapes requiring differently shaped spacers. The different types of spacers may be adapted for use with a standard plug. The plug is typically precision machined which is costly to produce. If a different plug has to be used with different types of spacers, one has to stock a supply of the different spacers which will result in an increase in operating cost.

FIG. 3 shows a centrifuge rotor 40 which is often referred to as fixed angle rotor. The cavities 41 in this rotor is inclined at an angle to the spin axis 42. A lid 46 is secured to the top center of the rotor by a locking mechanism 50 to cover the cavities. Annular gaskets 47 and 48 are provided between the lid 46 and rotor 40. The tube capping assembly is a variation of that shown in FIG. 2. A rotor cavity plug is not used to fix the spacer 44 in place. The spacer 44 is placed on top of the plug 20 to provide the centrifuge weight necessary to support the plug 20 against hydrostatic pressure in the tube 12. It is not necessary to fix the spacer 44 in place in the cavity because the centrifuge force component along the axis of the tube 12 on the spacer 44 is sufficient to provide the required support on the plug 20.

In this embodiment, in order for the self-sealing feature to function properly, the tube 12 has to be substantially filled with sample solution 54. As shown in FIG. 3, the sample solution 54 must come into contact with the root region of the tube stem 10 in order for the hydrostatic pressure within the tube to be able to force the tube stem 10 into sealing relation with the plug 20. Depending on the tilt of the axis of the cavity 41, the tube 12 has to be filled to a level such that the meniscus 58 during centrifugation is radially inward of the root region of the tube stem 10.

It is noted that upon centrifugation, the plug 20 is subject to a component of centrifugal force in a direction along the axis and towards the bottom of the tube 12. The plug 20 will not be centrifuged towards the bottom of the tube if it is made of a material less dense than the sample solution 54. For example, the density of polyphenylene oxide is about 1.06 $gm/cm^3$ which is less than the average density of a typical density gradient solution of over 1.1 $gm/cm^3$. Upon centrifugation, the hydrostatic pressure will always be less than the centrifugal pressure on the plug 20. Therefore, there is no resultant pressure which will force the plug 20 into the tube 12 during centrifugation.

FIG. 4 schematically shows a centrifuge rotor 60 in which the centrifuge tube 12 is held in a "bucket" 64 which swings outward to a horizontal position upon centrifugation. In the horizontal configuration, unless the tube 62 is completely filled, there is an air space between the plug 66 and the meniscus 68 during centrifugation. Therefore, the plug 20 is not subject to hydrostatic pressure. Thus the spacer 70 need not be supported by a rotor cavity plug screwed to the cavity of the bucket 64. In fact in this embodiment, the spacer 70 does not serve the purpose of supporting the plug 20 against hydrostatic pressure. Rather, the spacer 70 is utilized for supporting the top portion of the tube only. The spacer 70 should be of a density slightly less than the density of the sample solution 72 to avoid centrifuging the spacer 70 towards the bottom of the bucket 64 in the event the centrifuge tube 12 ruptures. Alternatively, a counterbore may be provided in the opening of the bucket 64 to restrain excessive movement of the spacer towards the bottom of the bucket.

Figure 5:
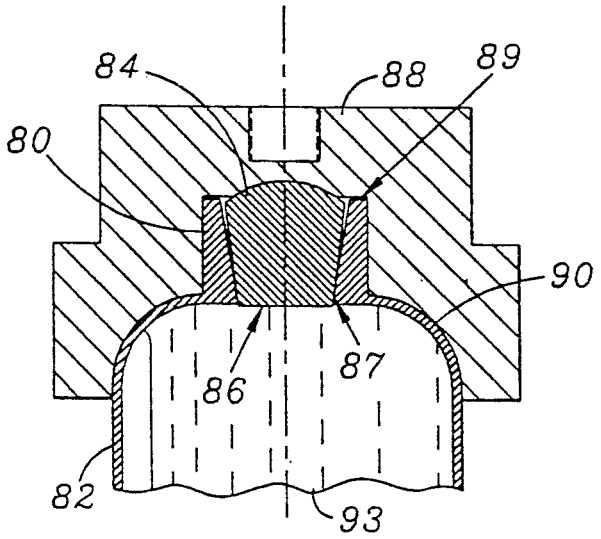
FIG. 5 shows a centrifuge tube and a capping assembly in accordance with another embodiment of the present invention.

Another embodiment of a capping assembly which makes use of hydrostatic pressure to perfect a seal is shown in FIG. 5. Like the previous embodiment, the stem 80 of the centrifuge tube 82 is conically tapered which defines an opening 86 for the tube. A plug 84 is designed to be received in the opening. The plug 84 is conically tapered having a rounded top at the wide end and a flat narrow end. The taper of the plug 84 is slightly less than the taper of the tube stem opening 86 by about one-half to one degree, such that when the plug 84 is received in the opening 86, there is a narrow band of contact 87 annularly between the plug 84 and the tube stem 80. A spacer 88 is provided which has an internal profile shaped to generally conform and mate to the plug 84 and the upper portion 90 of the tube.

The tube and plug assembly can be used in any one of the rotors in a similar manner as shown in FIGS. 2–4. Upon centrifugation, the hydrostatic pressure of the sample solution 93, which occurs as a result of centrifugal force acting on the sample solution within the tube, pushes on the root region of the tube stem 80. The tube stem 80 is pushed upwards forcing the tube stem 80 at point 87 into tighter contact with the plug 84 thereby forming a tight leak-proof seal. The sealing force is stronger with an increase in hydrostatic pressure at increased rotor speed. The space 89 allows room for the tube stem 80 to be pushed upwards. Similarly a space should preferably be provided between the top portion 90 and the spacer 88 to allow room for the top portion 90 to deform slightly to push the filler stem 80 upwards during centrifugation.

Figure 6:
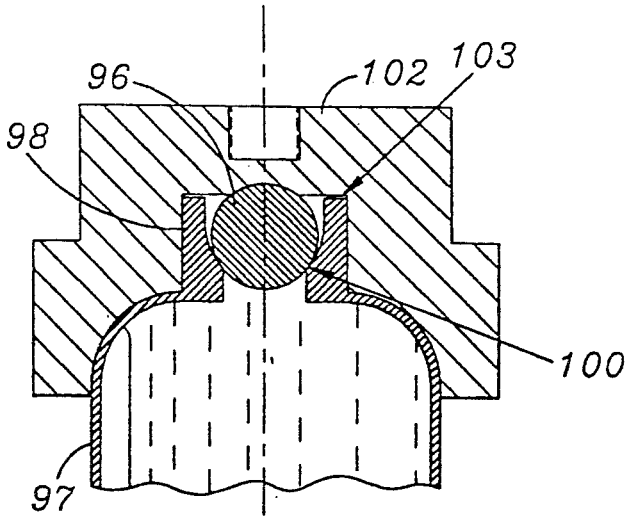
FIG. 6 shows a centrifuge tube and a capping assembly in accordance with a further embodiment of the present invention.

A further embodiment of a self-sealing plug is shown in FIG. 6. Instead of a conically tapered plug, a spherical or otherwise convex plug 96 is used in conjunction with a tube 97 having a stem 98 internally shaped to receive the plug 96. Specifically, the curvature of the internal shape of the stem 98 is slightly larger than the curvature of the spherical plug 96 such that the plug 96 rests on the stem 98 along a band of contact 100. The spacer 102 for use with this plug 96 is internally shaped to conform to the spherical top of the plug 96. A space 103 is provided for the same purpose as space 89 in the embodiment of FIG. 5. The self-sealing mechanism is similar to that described with respect to the preceding embodiment.

While the invention has been described with respect to the preferred embodiments in accordance therewith, it will be apparent to those skilled in the art that various modifications and improvements may be made without departing from the scope and spirit of the invention. For example, various combinations of the different embodiments of spacers, plugs, plugs and tubes are contemplated and can be made to obtain a seal using hydrostatic pressure. Accordingly, it is to be understood that the invention is not to be limited by the specific illustrated embodiments, but only by the scope of the appended claims.

I claim:

1. A centrifuge tube and closure comprising:

a centrifuge tube having a filler stem defining a tapered opening for introducing into and removing from the tube a sample solution;

a plug shaped to be received in the opening of the filler stem, the plug having an O-ring for making an initial seal against the filler stem; and means for supporting the plug against hydrostatic pressure of the sample solution but allowing relative axial movement of the filler stem toward the means for supporting during centrifugation so that the seal formed at the O-ring between the plug and the filler stem is tightened when the hydrostatic pressure forces on the filler stem against the plug.

2. A centrifuge tube and closure as in claim 1 wherein the supporting means is a spacer which is adapted to be securely fixed in position in a centrifuge rotor cavity so as to support the plug against hydrostatic pressure.

3. A centrifuge tube and closure as in claim 2 wherein the spacer is adapted to be fixed in position in a rotor cavity by a plug screwed into the opening of the cavity.

4. A centrifuge tube and closure as in claim 3 wherein the spacer is adapted to also support the centrifuge tube at its top region around the filler stem.

5. A centrifuge tube and closure as in claim 1 wherein the plug has a conically tapered body.

6. A centrifuge tube and closure as in claim 5 wherein the opening of the filler stem is tapered to receive the tapered body of the plug.

7. A centrifuge tube and closure as in claim 5 wherein the tapered body has a groove in which the O-ring is retained.

8. A centrifuge tube and closure as in claim 7 wherein the opening of the filler stem is tapered to receive the tapered body of the plug.

9. A centrifuge tube and closure as in claim 8 wherein the supporting means is a spacer which is adapted to be securely fixed in position in a centrifuge rotor cavity so as to support the plug against hydrostatic pressure.

10. A method of sealing a tapered filler stem opening of a centrifuge tube containing a sample solution comprising the steps of:

providing a conical plug, the plug having an O-ring;

plugging the filler stem with the plug to form an initial seal between the filler stem and the plug; and supporting the plug against the hydrostatic pressure of the sample solution but allowing relative axial movement of the filler stem and the plug toward one another during centrifugation so that the filler stem can be pressed against the plug by hydrostatic pressure to tighten the seal between the plug and the filler stem.

11. A centrifuge tube and closure assembly comprising:

a centrifuge tube having a body of a diameter and a filler stem of a smaller diameter extending therefrom defining a tapered opening for introducing into and removing from the tube a sample solution;

a tapered plug having an O-ring retained therein, whereby when the plug is inserted into tapered opening of the filler stem the O-ring makes an initial seal against the filler stem;

a support member having a recess sized to receive the filler stem with the plug inserted therein whereby the support member presses on the plug but leaves a space between the support member and the filler stem for the filler stem to move relatively towards the support member during centrifugation against hydrostatic pressure of the sample solution, thereby tightening the seal at the O-ring between the filler stem and the plug.

12. An assembly as in claim 11 wherein the plug has a groove which retains the O-ring therein.

13. An assembly as in claim 11 wherein the support member supports the body at its top portion around the filler stem.

* * * * *